United States Patent [19]

Lovitt

[11] 4,281,868

[45] Aug. 4, 1981

[54] RAIL THREADING DEVICE

[75] Inventor: Estel L. Lovitt, Toledo, Ohio

[73] Assignee: Mitchell Equipment Corp., Toledo, Ohio

[21] Appl. No.: 21,183

[22] Filed: Mar. 16, 1979

[51] Int. Cl.[3] ..... B66C 1/64

[52] U.S. Cl. ..... 294/106; 104/1 R; 294/85

[58] Field of Search ..... 294/85, 86 R, 106, 110 R, 294/113, 115, 116, DIG. 2; 104/1 R, 2, 95; 414/747

[56] References Cited

U.S. PATENT DOCUMENTS

| | | | |
|---|---|---|---|
| 868,945 | 10/1907 | Sewall | 294/106 |
| 870,713 | 11/1907 | Christianson | 294/110 R |
| 1,144,387 | 6/1915 | Skelton | 294/116 |
| 1,683,463 | 9/1928 | Healy | 294/113 X |
| 1,877,974 | 9/1932 | Robb | 414/747 |
| 3,203,360 | 8/1965 | Renfroe et al. | 294/85 X |
| 3,451,711 | 6/1969 | Carpenter | 294/113 |
| 3,632,152 | 1/1972 | Renfroe | 294/85 |

FOREIGN PATENT DOCUMENTS

| | | | |
|---|---|---|---|
| 133428 | 1/1979 | German Democratic Rep. | 294/106 |

*Primary Examiner*—Johnny D. Cherry
*Attorney, Agent, or Firm*—Kenneth F. Cherry

[57] ABSTRACT

An improvement in rail threading devices having at least four rollers mounted on two rectangular plates. Each rectangular plate is fastened by a stud to a framing member which allows movement of the rectangular plate relative to the framing member. The framing members are mechanically attached together so that the rollers will straddle a section of rail and grip the rail from the underside of the rails' upper section when the device is lifted by a crane. The mechanical attachment of the framing members is such that the device can be used to lift a rail which is on the ground and further allow the rollers to be separated when the tension on an attached crane cable is relaxed thereby providing for ease in removal or attachment of the device.

3 Claims, 5 Drawing Figures

RAIL THREADING DEVICE

BACKGROUND OF THE INVENTION

This invention is an improvement in Rail Threading Devices as used to install welded rail sections for railroad use.

Prior art in the area of rail threaders includes roller containing devices which are used from cranes. These devices have a portion which extends below the bottom of the rail section which require the rail to be lifted above the ground to install the devices in a position for use. The currently used rail threaders also require several inches clearance between the rail and ground level to allow the threader to move. This clearance results in the necessity of using two or more men to guide the track into its final resting position.

BRIEF SUMMARY OF THE INVENTION

This invention is a rail threading device which is used with a conventional crane to place sections of track onto their final resting location. The device has two sets of rollers which grip the track from above and clamp under the upper section of the rail. This arrangement provides a unique method to grab a rail without prior lifting of the rail above ground level and further allows exact placement of the rail because no appreciable clearance between rail and ground level is required for operation of the device. The wheels are mounted on moveable rectangular mounting plates which allow the rollers to follow the contour of the rail and the moveable rectangular mounting plates are attached to hinged framing members to provide for ease in attaching and removing the device.

DETAILED DESCRIPTION

The present invention relates to an improvement in rail threader apparatus and more particularly to a threader device suspended from a conventional crane as presently used for rail threading.

This invention reduces the problems encountered in laying continuous "ribbon rail" sections as are now commonly used in this country. In practice, sections of rail are placed along the existing track and placed in position after sections of the old track are removed. Present practice utilizes threader devices which are placed around the section of rail after it has been lifted a suitable distance off the ground. The rail is then placed in its approximate position using a threader in combination with a crane. Care must be taken to allow clearance between the threader and the tie plates on which the rail is mounted. This required distance between rail and tie plates results in the necessity of utilizing a crew of several men to guide the rail into position using metal rods as guiding tools. This invention allows the rail to be attached to the threader in the position in which it is laying along the rail bed then roll the rail into an upright position and begin threading in a single operation. While the threading operation is in progress the operator of the crane to which the threader is attached may position the rail directly on to the tie plates under the threader. This feature allows minimum twist of the rail and improves operator control.

Figure 1:
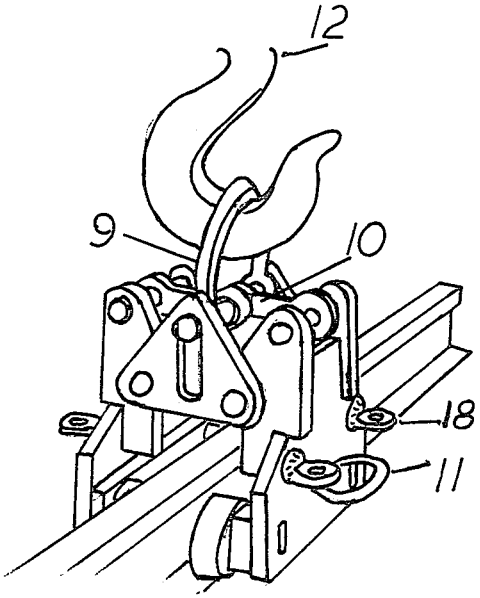
FIG. 1 is an isometric view of the device in use.

To better understand the operation of the device reference is made to the drawings:

FIG. 1 shows the device in use suspended from a hook which is presumed attached to the boom of a conventional crane. It is in this configuration the invention is intended for use. Particular attention is called to the "U" shaped attachment ring (9) and transport ring (11). The "U" shaped attachment ring is not shown in the other figures because it would obscure the function of other features of the invention but it is required for the invention to function as described herein.

Figure 2:
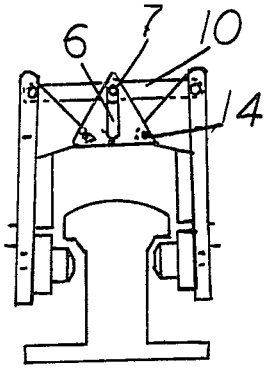
FIG. 2 is a view of the device in the closed position.
Figure 3:
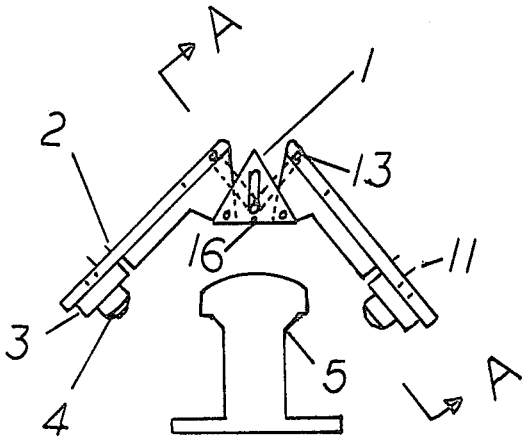
FIG. 3 is a view of the device in the open position.
Figure 4:
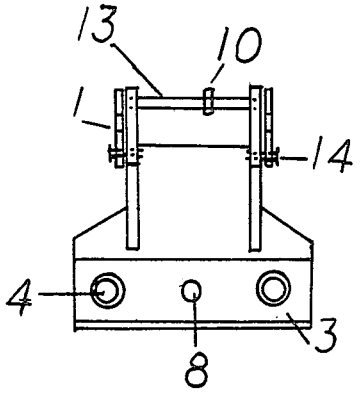
FIG. 4 is section AA of FIG. 3.

FIG. 2 shows the device in the closed position and FIG. 3 in an open position while FIG. 4 is a simplified section AA of FIG. 2. A positioning arm (10) is pivotly attached to a main connecting rod (7) and each of two framing members (2) through frame rods (13). The main connecting rod is positioned in a vertical slot (6) in each of 2 triangular connecting means (1). The triangular connecting means are attached by pivot pins (14) to each of the framing members. All studs and rods such as shown by Nos. 8, 7, 14, 13 require a securing means such as nuts, welded caps or similar devices so they won't slip out during use.

Attachment of the mechanical members is such that when the connecting rod (7) is in the upper position resulting from the applied upward lifting force of the hook (12) through the "U" shaped attachment ring (9) as shown in FIG. 1 the positioning arms force the framing members into the vertical closed position as shown in FIG. 2. Also when the connecting rod (7) is in the lower position in the vertical slot as shown in FIG. 3 the resulting action of the positioning arms on the framing members about the pivot pins (14) results in opening of the device as shown in FIG. 3. This allows the device to be placed on a rail section (5). In practice an open position resulting from approximately 20° movement of each framing member is sufficient for the wheels to clear the rail section.

FIG. 4 shows section AA of FIG. 3. This view shows the position of the rollers (4) with their axis perpendicular to the framing member and mounting stud (8), parallel to the wheel axis, on which the rectangular plate pivots to conform to the rail and ensure contact of all rollers with the rail as the device moves along the rail. Since the major plane of the rectangular plate and framing member are parallel, the stud and wheel axis are perpendicular to these planes.

The rollers shown have a cambered front surface to conform to the shape of standard rails. The angle most suited to standard American rails is approximately 14°. It has also been noted that dual bearing hardened steel rollers perform in a more satisfactory manner than lighter duty units which tend to deform as a result of the applied weight of the rail.

The rollers are preferably of steel with roller bearings to support the loads imposed by typical rail sections. Further it is understood that minor variations in the various members of the device resulting from construction methods which are a matter of choice are equivalent to the disclosed invention. Such variations will result from the choice of casting or welding the framing members. The inventor acknowledges essentially equivalent construction methods to the welded construction shown are applicable and defined as equivalent for the purposes of this document.

Further it is recognized by all familiar with the art that rail sections as in common use today have several weight classifications and sound engineering practice requires suitable easy to service hardened roller bearings be chosen to withstand the weight of the rail sections used. Also the preferred metal of construction for the device is steel and experience has shown a nominal thickness of $1\frac{1}{4}$ inch for the major members such as the framing members and triangular connecting means is suitable.

Figure 5:
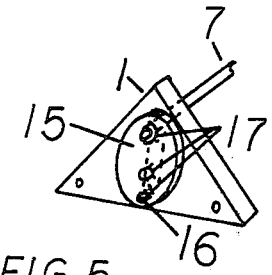
FIG. 5 is a sketch of a locking device.

In practice it has been found that a means to lock (15) as shown in FIG. 5 is useful to hold the device opened or closed. A member with holes (17) to fit over a position pin (16) and the connecting rod (7) can be used to prevent movement of the connecting rod in the vertical slot and thereby lock the device open or closed. A simple cotter pin or similar means through the connecting rod will hold the means to lock in place. Another feature which is sometimes useful is the attachment rings (18) as shown in FIG. 1. These rings are attached by a cable to the lower area of a crane, preferably to a takeup reel, and adjustment of the cable can limit the distance at which the invention follows the crane while being used.

Having described the invention I claim:

1. An improved rail threading device for use with a crane comprising two framing members both attached by pivot pins to each of two triangular connecting means, the triangular connecting means having a vertical slot and extending through both slots a main connecting rod, at least one positioning arm attached to each framing member and the main connecting rod, the attachment of the positioning arms to each framing member by means of a framing member frame rod, a "U" shaped attachment ring attached to the main connecting rod, further, on each framing member a rectangular plate mounted about a mounting stud, each rectangular plate having thereon mounted at least two wheel means, the axis of said wheel means parallel to the mounting stud and perpendicular to the major plane of the rectangular plate and framing member.

wherein movement of said main connecting rod within said slots results in movement of said framing members so that lifting of said main connecting rod by said "U" shaped attachment ring results in a gripping action about a rail when the rail is positioned between said rectangular plates.

2. The invention of claim 1 wherein a means to lock having at least two holes in a flat member functions to restrict the movement of said main connecting rod relative to said triangular connecting means.

3. The invention of claim 1 wherein at least one attachment ring is fastened to a framing member and when used in combination with a cable attached to the crane will limit the distance between the rail threading device and the crane.

* * * * *